United States Patent [19]

Kudinov et al.

[11] 4,250,840

[45] Feb. 17, 1981

[54] BLAST FURNACE COOLING ARRANGEMENT

[76] Inventors: Gennady A. Kudinov, ulitsa Geroev Truda, 20a, Kv. 98; Evgeny E. Lysenko, ulitsa Novgorodskaya, 38/44, Kv. 3; Oleg V. Filipiev, prospekt Pravdy, 5, Kv. 4/b; Grigory I. Kasyanov, prospekt Lenina, 64b, Kv. 63; Jury I. Tseluiko, prospekt, Lenina, 17, Kv. 55; Yakov I. Gorodetsky, ulitsa Sotsialisticheskaya, 72, Kv. 34, all of Kharkov; Viktor D. Kotlyar, ulitsa 1 Maya, Juzhny Kharkovskoi oblasti, all of U.S.S.R.

[21] Appl. No.: 12,452

[22] Filed: Feb. 15, 1979

[51] Int. Cl.[3] ..... F22B 37/00

[52] U.S. Cl. ..... 122/6 A; 110/336; 122/406 R; 266/193

[58] Field of Search ..... 122/6 R, 6 A, 7 R, 406 R; 266/193; 165/101, 95; 110/336

[56] References Cited

U.S. PATENT DOCUMENTS

| | | | |
|---|---|---|---|
| 3,692,103 | 9/1972 | Andoniev et al. | 266/193 X |
| 3,704,747 | 12/1972 | Andoniev et al. | 165/101 |
| 3,966,179 | 6/1976 | Andoniev et al. | 266/193 |
| 4,026,352 | 5/1977 | Andoniev et al. | 165/95 |
| 4,061,317 | 12/1977 | Andoniev et al. | 266/193 |

*Primary Examiner*—Edward G. Favors
*Attorney, Agent, or Firm*—Lackenbach, Lilling & Siegel

[57] ABSTRACT

A blast furnace cooling arrangemenet comprises a cooling screen which is disposed in an annular space between a furnace shell and its lining, and which is formed by vertically arranged rows of plates provided with main and additional internal ducts having common inlets and common outlets. Mounted above the cooling screen are drum separators which communicate through supply pipelines and take-off pipelines with the common inlets and outlets of the main and additional ducts of the plates of each vertical row, the above elements forming closed circuits of natural circulation of a cooling medium. Connected at the common inlets and outlets of the additional ducts of the vertical rows of the plates are circuits of forced circulation of a cooling medium. Each of the circuitsof forced circulation comprises a container communicating with the common outlet of the additional ducts, a heat exchanger connected with the container, and a pump communicating through its inlet with the heat exchanger and through its outlet with the common inlet of the additional ducts in the vertical row of the plates. The common inlets and outlets of the additional ducts are provided with distributing valves intended to selectively connect the additional ducts to the circuits of natural and forced circulation of a cooling medium.

5 Claims, 8 Drawing Figures

BLAST FURNACE COOLING ARRANGEMENT

BACKGROUND OF THE INVENTION

1. Field of the Invention

The present invention relates to ferrous metallurgy and more particularly to furnace cooling arrangements.

The invention may be employed with particular advantage for cooling hearths, boshes, and stacks of blast furnaces.

The problem of enhancing the efficiency of cooling the blast furnace portions exposed to the most extensive heating is comparatively old and, despite numerous attempts directed to the solution thereof, has not been adequately solved up till now. This has been evidenced by grave accidents to blast furnaces which took place in a number of industrically developed countries during the last five years. Some of these accidents involved loss of human lives, and the total damage to industrial enterprises amounted to several millions of dollars. All the above accidents were due to inefficiency in cooling of a furnace shell, which in case of a lining burnout resulted in a local melting of furnace coolers and the shell and in liquid metal breaking out from the blast furnace.

2. Description of the Prior Art

To cool the lower portion of a blast furnace stack and bosh, there is still utilized a water cooling arrangement comprising box-like cooling elements disposed in vertical rows between a furnace shell and lining and its connected through a supply pipeline and a take-off pipeline to a process water main and to a cooling medium source, as disclosed in U.S. Pat. No. 3,628,509 and in FRG Pat. No. 2,041,399.

In intensified iron making processes, for instance with oxygen blast, at elevated pressures in a furnace and at a large volume thereof, the box-like coolers fail to provide effective heat removal. The box-like coolers are built in the lining, and as the lining breaks down they go out of action as well. Another disadvantage of the arrangement under consideration is that the box-like coolers ensure only local cooling. And, finally, it is impossible to provide for reliable tightness in those sections of a furnace shell where the box-like coolers are built.

In cooling a hearth and a hearth bottom of conventional blast furnaces, use is at present made of the above arrangement in combination with cooling plates disposed in an annular space between a furnace shell and a lining.

In some cases, the hearth and the hearth bottom may be cooled by watering the furnace from outside, in addition to employing cooling plates.

Provided that the lining is undamaged, the thermal loads imposed on the cooling plates are not high and the arrangement operates normally. In the event of a damaged lining, the arrangement fails to provide for sufficiently intensive removal of heat. Under these conditions, there arises a possibility of local melting of the cooling plates. When the liquid iron comes into contact with the cooling water, an explosion occurs which results in destruction of the furnace shell. As calculations have shown, the liquid iron can be prevented from breaking out of the furnace through the cooling members only if the velocity of the cooling water within the arrangement is not lower than 8 to 10 m/sec. Such being the case, the cooling of the furnace bottom portion alone requires an enormous amount of water, namely from 3000 to 4000 $m^3/h$ at a pressure from 10 to 15 atm. It will be understood that pumps of the above capacity are provided with powerful drives and, hence, the power consumption of the arrangement is extremely high.

With these considerations in view, more promising proved to be an arrangement of evaporative cooling comprising a cooling screen formed by vertically arranged rows of plates provided with series-connected internal ducts communicating vertically and connected through supply pipelines and take-off pipelines with drum separators, as disclosed in FRG Pat. No. 1,931,957.

The internal ducts of each plate are disposed in the same plane and form natural circulation circuits with a respective drum separator. In operation, the cooling water within the internal ducts of the plates becomes heated to its boiling point and flows into the drum separator wherein the liquid phase and the steam phase are separated from each other and wherein a partial steam condensation occurs. The difference in the specific gravity of a steam-and-water mixture in the take-off pipeline and a cooled water in the supply pipeline is responsible for a natural repeated circulation. An obvious advantage of the evaporative cooling arrangement consists in a comparatively intensified circulation of a cooling agent without any pumps and additional power consumption.

It will be understood that the reliability of the evaporative cooling will be higher when more circulation circuits are provided within the plates of the cooling screen, as disclosed in U.S. Pat. No. 3,704,747. According to the specification the internal ducts of each plate are arranged in two planes, which provides for a more efficient removal of heat.

However, in the event of liquid metal reaching the plates of the cooling screen through a damaged lining, the arrangement under consideration does not provide for sufficient heat removal either, which is due to the fact that the water velocity within the natural circulation circuits should be 8 to 10 m/sec, a value which practically cannot be attained by natural circulation.

Known in the art is a blast furnace cooling arrangement which combines the advantages of the above arrangements of water cooling and evaporative cooling, as described in U.S. Pat. No. 4,061,317. This arrangement comprises a cooling screen arranged in an annular space between a furnace shell and its lining. The cooling screen is composed of plates forming vertical rows and incorporating series-connected main and additional internal ducts communicating vertically with each other. Both the main and the additional ducts have common inlets and outlets. Mounted above the cooling screen are drum separators communicating through supply pipes and take-off pipes with common inlets and outlets of the main and the additional ducts in vertical raws of the plates and forming closed circuits of natural circulation. Through distributing valves the additional ducts are connected to a process water supply main and form therewith a open circuit of forced circulation. The distributing valves are mounted at the common inlets and outlets of the additional ducts and permit a selective connection thereof to the circuits of forced circulation.

Provided the lining is in good working order, the additional ducts of the plates in each row are connected to the circuits of natural circulation, and the arrangement operates without any extra consumption of power. In the event of a damaged lining, the additional ducts are cut off from the circuit of natural circulation and connected to the open circuit of forced circulation, i.e. to the process water supply main. A high velocity of the process water within the additional ducts provides for an efficient removal of heat from the plates located in the hazardous zone, thereby preventing them from breaking down.

However, in emergency conditions the arrangement being considered suffers from the formation of scale deposits on the interior surface of the additional ducts. In long-time operation, the scale deposits grow thicker, whereby heat exchange between the plates and the furnace lining is materially affected even at high velocities of the process water. This disadvantage may be overcome by decreasing the content of salts in the water fed into the additional ducts at a rate of 3000 to 4000 $m^3/h$, but purification of water in such quantities is extremely expensive and will not be compensated by a longer service life of the cooling screen.

SUMMARY OF THE INVENTION

The principal object of the present invention is to provide a blast furnace cooling arrangement which enables a relatively small amount of chemically pure water to be used for feeding the additional ducts of the plates located in a hazardous zone and at the same time assures a high velocity of water circulation.

Another important object of the present invention is to prevent the formation of scales on the interior surfaces of the additional ducts.

One more object of the invention is to provide a blast furnace cooling arrangement which ensures high efficiency of thermal protection during long-time operation of the blast furnace.

An additional object of the invention is to improve the reliability of the blast furnace cooling arrangement.

Still another object of the invention is to provide a blast furnace cooling arrangement which ensures a well-timed transition from natural to emergency conditions of operation.

These and other objects of the present invention are attained in a blast furnace cooling arrangement comprising a cooling screen which is disposed in an annular space between a furnace shell and its lining, and which is formed by vertically arranged rows of plates provided with series-connected main internal ducts and additional ducts communicating vertically and having common inlets and common outlets. Drum separators are mounted above the cooling screen and communicate through supply pipelines and take-off pipelines with the common inlets and the common outlets of the main ducts and additional ducts in the vertical rows of the plates and form closed circuits of natural circulation of a cooling medium. Distributing valves are mounted at the common inlets and the common outlets of the additional ducts in the vertical rows of the plates for selectively connecting said ducts to the circuits of natural circulation and to circuits of forced circulation. According to the invention, each circuit of forced circulation is closed and comprises a container communicating with the common outlet of the additional ducts in a respective vertical row of the plates, a heat exchanger connected with said container, and a pump communicating through its inlet with the heat exchanger and through its outlet with the common inlet of the additional ducts in the vertical row of the plates.

Thus the constructional arrangement of the circuit of forced circulation, as well as the mode of its connection with the cooling arrangement, provides for a considerable flow rate and velocity of chemically pure water in the additional ducts, though the amount of water in the circuit is comparatively small. The chemically pure water prevents the formation of scales, lengthens the service life and enhances the efficiency of the arrangement, and practically eliminates accidents.

It is desirable that the containers of the circuits of forced circulation be disposed level with the drum separators and communicate therewith through pipelines under and above the level of the cooling liquid, thereby forming pairs, "container-drum separator".

Due to such constructional arrangement, the drum separators and the containers are connected to a common water level maintenance pipeline, have common safety valves and common level indicators.

It is also desirable that the pipelines connecting the containers with the drum separators be provided with shut-off valves adapted to disconnect the containers from the drum separators during emergency conditions.

It is also preferable that the closed circuit of forced circulation be provided with a by-pass pipeline having distributing valves and connected in parallel with the heat exchanger. This design feature enables the circuit of forced circulation to temporarily function in case the heat exchanger is damaged and is being repaired or replaced.

It is also preferable that the common inlet of the additional ducts in each vertical row of plates, connected to the closed circuit of forced circulation, be disposed level with the hearth bottom, and the common outlet be disposed level with the middle portion of the stack. Such a modification of the cooling arrangement is the most dependable one and provides for an efficient protection of the plates and the shell in case some irregularities occur in the blast furnace run.

BRIEF DESCRIPTION OF THE DRAWINGS

For a better understanding of the nature and objects of the invention reference is made to the following detailed description of specific embodiments, taken in connection with the accompanying drawings, in which.

DETAILED DESCRIPTION OF THE INVENTION

Figure 1:
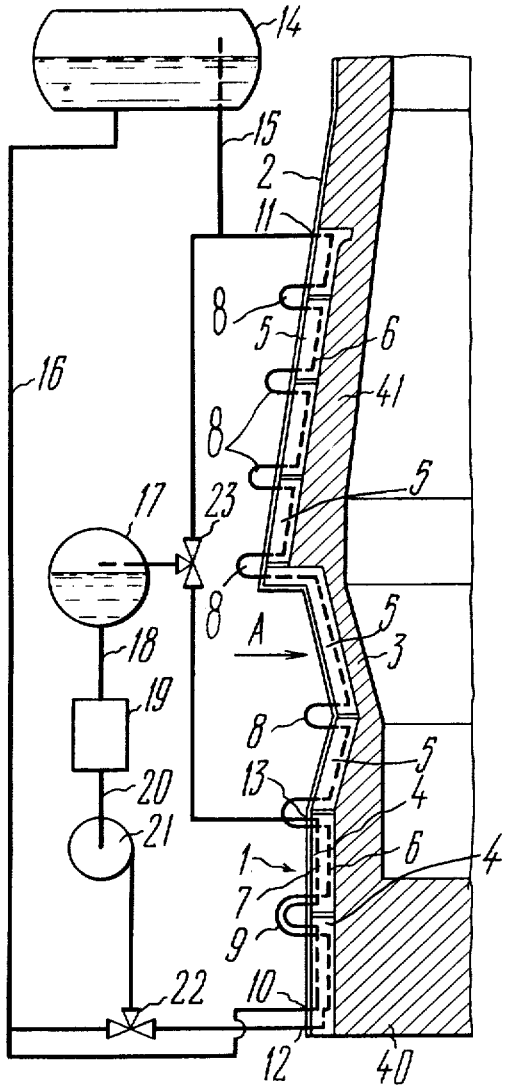
FIG. 1 is a front elevational view of a blast furnace cooling arrangement of the present invention.

Referring to FIG. 1, a blast furnace cooling arrangement comprises a cooling screen 1 disposed in an annular space between a furnace shell 2 and its lining 3. The cooling screen 1 is formed by vertically arranged rows of plates 4 and 5. The plates 4 are provided with main internal ducts 6 and additional internal ducts 7, whereas the plates 5 are provided with the main internal ducts 6 only. The main ducts 6 in a vertical row of the plates 4 and 5 are connected in series and vertically communicate with each other through connectors 8. The additional ducts 7 in a vertical row of the plates 4 are connected in series and vertically communicate with each other through connectors 9. Thus, the main ducts 6 in the vertical row of the plates 4 and 5 have a common inlet 10 and a common outlet 11. The additional ducts 7 in the vertical row of the plates 4 have a common inlet 12 and a common outlet 13 as well. Mounted above the cooling screen 1 are drum separators 14 communicating with the common inlets 10 and 12 and with the common outlets 11 and 13 of the main ducts 6 and the additional ducts 7 in the vertical rows of the plates 4 and 5. The common outlets 11 and 13 are connected with the drum separators 14 through take-off pipelines 15, and the common inlets 10 and 12 are connected with the drum separators 14 through supply pipelines 16. In this way the ducts and the hollow spaces of all the enumerated elements make up a closed circuit of natural circulation of a cooling medium. From the economical point of view, chemically pure water is the most suitable cooling medium.

In addition to the circuits of natural circulation, there are circuits of forced circulation placed in parallel therewith and connected to the common inlets 12 and the common outlets 13 of the additional ducts 7 in the vertical rows of the plates 4. According to the invention, each circuit of forced circulation is closed and comprises a container 17 connected with the common outlet 13 of the additional ducts 7 in a respective vertical row (or several rows forming a section) of the plates 4. The container 17 communicates through a pipe 18 with a heat exchanger 19 which, in turn, communicates through a pipe 20 with the inlet of a pump 21. The outlet of the pump 21 communicates with the common inlet 12 of the additional ducts 7 of a respective vertical row (or rows) of the plates 4.

Distributing valves 22 are mounted at the common inlets 12 and distributing valves 23 are mounted at the common outlets 13 of the additional ducts 7. The distributing valves 22 and 23 may be made in the form of three-way cocks so as to selectively connect the additional ducts 7 to the circuits of natural circulation and to the circuits of forced circulation of a cooling medium.

The circuit of forced circulation is filled with chemically pure water.

Figure 2:
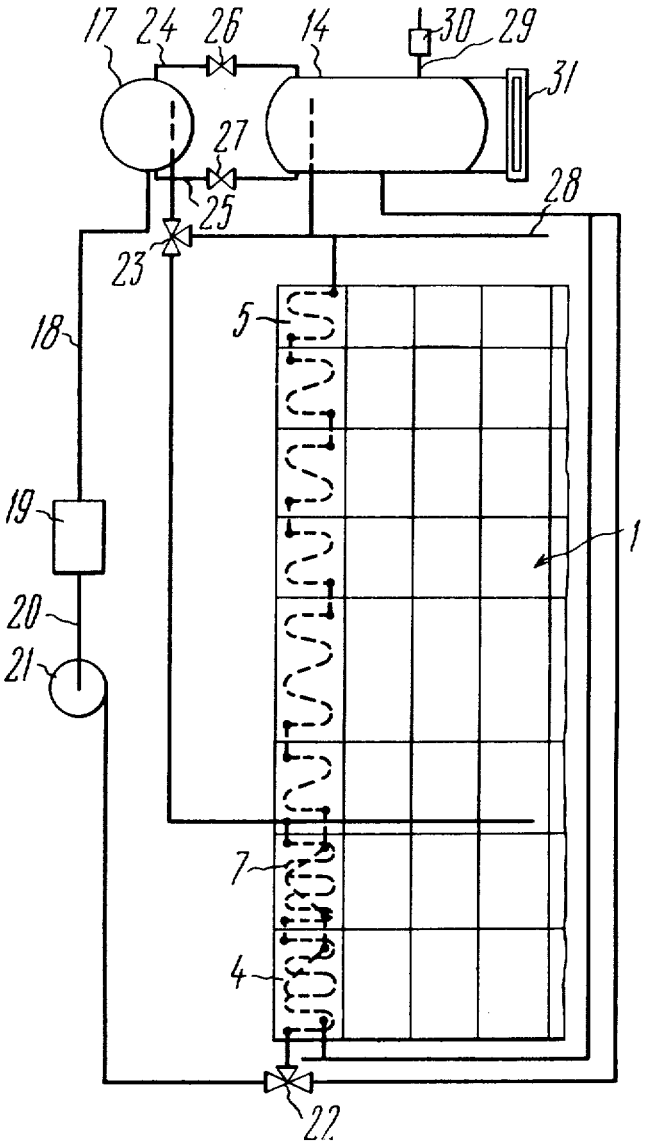
FIG. 2 is a side elevational view showing the blast furnace cooling arrangement, viewed in the direction of arrow A of FIG. 1 wherein, the container and the drum separator are disposed at the same level.

Reference is now made to FIG. 2 illustrating vertical rows of the plates 4 and 5. According to a preferred embodiment of the invention, the containers 17 of the circuits of forced circulation are disposed level with the drum separators 14. Said containers 17 communicate with respective drum separators 14 through pipelines 24 and 25, thereby forming pairs, "container-drum separator". The pipeline 24 connects the inner space of the container 17 and that of the drum separator 14 above the level of a cooling medium contained therein, whereas the pipeline 25 connects the spaces under the level of the same cooling medium. The pipelines 24 and 25 are fitted with shut-off valves 26 and 27. In its bottom portion each drum separator 14 is connected with a water level maintenance pipeline 28, and in its upper portion it is provided with a steam exhaust pipe 29 which incorporates a safety valve 30. The drum separators 14 are fitted with level indicators 31.

Figure 3:
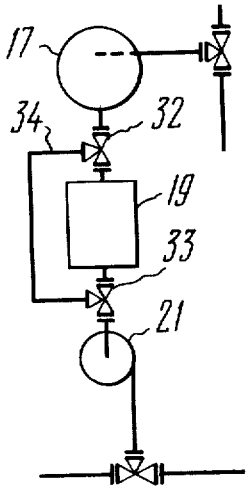
FIG. 3 illustrates the part of the circuit of forced circulation with the by-pass pipeline, according to the invention.

Reference is now made to FIG. 3 illustrating a part of the circuit of forced circulation. According to the invention there is provided a by-pass pipeline 34 connected in parallel with the heat exchanger 19 through distributing valves 32 and 33.

Figure 4:
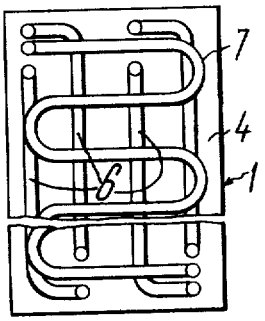
FIG. 4 illustrates a modification of the cooling screen plate provided with straight main ducts and with additional ducts in the form of a coil pipe.

It will be understood that the blast furnace cooling arrangement described above may be fitted with variously constructed plates. Specifically the plates 4 of the cooling screen 1 may be constructed as shown in FIG. 4 of the accompanying drawings. The main ducts 6 of this modification may be straight pipes contained in the body of the plate 4 and disposed in one plane. The additional duct 7 of each plate, according to this modification, may be made in the form of a coil pipe.

Figure 5:
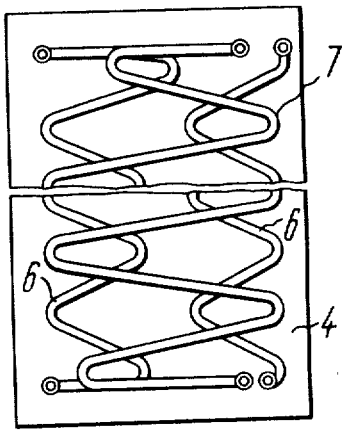
FIG. 5 illustrates a second modification of cooling screen plate provided with the main and additional ducts in the form of coil pipes.

More preferable for the purpose of the present invention is the modification of the plate 4 shown in FIG. 5 of the accompanying drawings. According to this modification both the main ducts 6 and the additional ducts 7 are coil pipes disposed in different planes.

Figure 6:
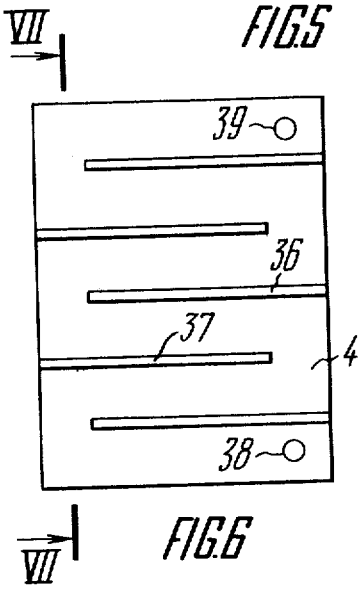
FIG. 6 illustrates a third modification of the cooling screen plate shaped as a box with partitions forming a labyrinth.
Figure 7:
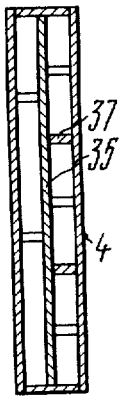
FIG. 7 is a crossline 3, sectional view of the cooling screen plate taken along the line VII—VII of FIG. 6.

Possible is a modification of the plate 4 shown in FIGS. 6 and 7 of the accompanying drawing. According to this modification, the plate 4 is hollow and its inner space is divided into two inner spaces by a longitudinal partition 35. On either side of the partition 35 the inner spaces of the plate 4 are divided by transverse partitions 36 and 37 forming a labyrinth between an inlet 38 and an outlet 39.

Figure 8:
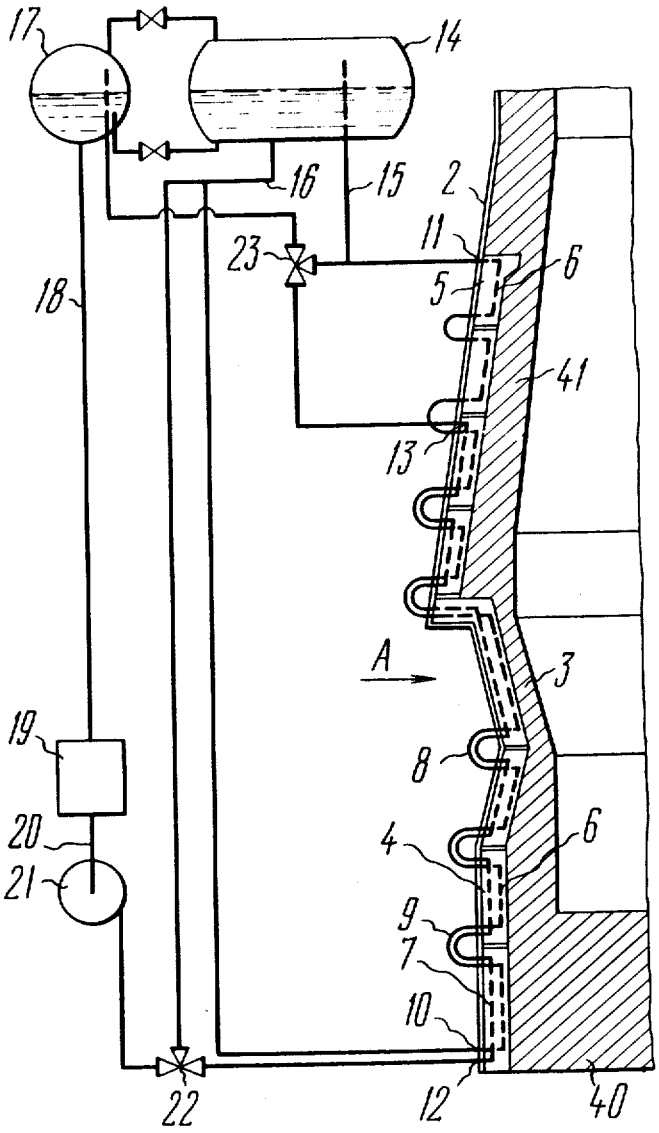
FIG. 8 is a front elevational view of another preferred embodiment of the cooling arrangement of the present invention.

Reference is now made to FIG. 8 wherein the most reliable modification of the blast furnace cooling arrangement is shown. The common inlet 12 of the additional ducts 7 in each vertical row of the plates 4 is disposed level with a hearth bottom 40 of the blast furnace, and the common outlet 13 of the additional ducts 7 is disposed level with the middle portion of a stack 41.

The blast furnace cooling arrangement operates in the following way. Provided the lining 3 (FIG. 1) of the blast furnace is undamaged, the cooling arrangement operates on evaporative cooling with natural circulation. Specifically, the cooling medium from the drum separators 14 flows through the supply pipelines 16 to the common inlets 10 and 12 of the main ducts 6 and the additional ducts 7 in each vertical row of the plates 4. As this takes place, the circuit of forced circulation is disconnected. Flowing through the main and additional ducts 6 and 7 the cooling medium cools the plates 4 and 5, while its own temperature increases toward its boiling point. The separation of the steam phase may occur both in the ducts of the plates and in the take-off pipelines 15. The resulting steam-and-water mixture flows through the common outlets 11 and 13 and through the take-off pipelines 15 to the drum separators 14. The difference in the specific gravity of the steam-and-water mixture in the take-off pipelines 15 and the cooling liquid in the supply pipelines 16 provides for a stable natural circulation. Normal operating conditions of the arrangement are maintained with the aid of the water level maintenance pipeline 28 (FIG. 2) and the safety valve 30.

Provided the circuit of natural circulation is in good working order, the shut-off valves 26 and 27 of the modification of the cooling arrangement illustrated in FIG. 2 of the accompanying drawings are opened. In the event of a burning-out of the lining and liquid metal reaching the cooling screen 1 (which may be indicated by an increase in the temperature difference of the cooling medium, caused by an increase in the temperature of the furnace shell 2 etc.), the thermal loads imposed on the plates 4 located in the hazardous zone sharply increases.

When a signal indicative of the burning out of the lining 3 comes, the shut-off valves 26 and 27 block the pipelines 24 and 25. Simultaneously therewith, the additional ducts 7 in respective rows of the plates 4 are disconnected from the circuits of natural circulation and connected to the circuits of forced circulation by means of distributing valves 22 and 23. As this takes place, chemically pure water comes from the container 17 to the pump 21 through the heat exchanger 19. The pump 21 is brought into use and supplies the chemically pure water at a high velocity (of the order of 10 m/sec) into the additional ducts 7 in respective rows of the plates 4. The sections of the cooling screen which are located remotely from the damaged area of the lining 3 continue operating normally in the conditions of natural circulation, whereas the plates located in the hazardous zone are cooled due to an intensive forced circulation of the cooling medium.

If the heat exchanger 19 is damaged, clogged, or rails to operate, it is cut off from, and the pass-by pipeline 34 is connected to, the cooling arrangement with the aid of the distributing valves 32 (FIG. 3) and 33. The chemically pure water temporarily circulates through the by-pass pipeline 34 from the container 17 to the pump 21 so as to allow the heat exchanger 19 to be repaired or replaced. In this way, the arrangement of the circuit of forced circulation provides for an efficient cooling of the plates 4 with a relatively small volume of chemically pure water in emergency conditions.

The modification of the cooling arrangement illustrated in FIG. 8 of the accompanying drawings makes it possible to effectively cool, in case of necessity, not only the hearth and the hearth bottom but the bosh and the lower portion of a blast furnace stack as well.

After the operation is over and the damaged lining 3 is repaired, the cooling arrangement is brought back to its original state for operation in the conditions of natural circulation of a cooling medium.

While particular embodiments of the invention have been shown and described, various modifications thereof will be apparent to those skilled in the art and, therefore, it is not intended that the invention be limited to the disclosed embodiments or to the details thereof and departures may be made therefrom within the spirit and scope of the invention as defined in the claims.

What is claimed is:

1. A blast furnace cooling arrangement comprising:

(a) a cooling screen disposed in an annular space between a furnace shell and a lining and formed by vertically arranged rows of plates provided with series-connected main internal ducts and additional internal ducts communicating vertically and having common inlets and common outlets;

(b) drum separators mounted above said cooling screen and communicating with said common inlets and outlets of said main and additional ducts of said plates of each vertical row;

(c) take-off pipelines connecting said common outlets of said main and additional ducts of said plates of each vertical row with said drum separators;

(d) supply pipelines connecting said drum separators with said common inlets of said main and additional ducts of said plates of each vertical row and forming with the above elements a closed circuit of natural circulation of a cooling medium;

(e) circuits of forced circulation, each of which is closed at said common inlet and outlet of said additional ducts in a respective vertical row of said plates and comprises:

(1) a container communicating with said common outlet of said additional ducts in the vertical row of said plates;

(2) a heat exchanger communicating with said container; and (3) a pump communicating through its inlet with said heat exchanger and through an outlet, with the common inlet of said additional ducts in the vertical row of said plates; and (f) distributing valves mounted at said common inlets and outlets of said additional ducts in the vertical rows of said plates to selectively connect the additional ducts to the circuits of natural circulation in normal operating conditions and to the circuits of forced circulation during emergency conditions.

2. An arrangement as claimed in claim 1, wherein said containers of the closed circuits of forced circulation are disposed level with said drum separators and communicate therewith through pipelines under and above the level of the cooling liquid, thereby forming pairs "container-drum separator".

3. An arrangement as claimed in claim 2, wherein said pipelines connecting said containers with said drum separators are provided with shut-off valves.

4. An arrangement as claimed in claim 1, wherein the closed circuit of forced circulation is provided with a by-pass pipeline disposed in parallel with said heat exchanger and having distributing valves.

5. An arrangement as claimed in claim 1, wherein said common inlet of said additional ducts in each vertical row of said plates, connected to the closed circuit of forced circulation, is disposed level with a furnace hearth bottom, and the common outlet is disposed level with the middle portion of a stack.

* * * * *